US008279025B2

(12) United States Patent
Cho

(10) Patent No.: US 8,279,025 B2
(45) Date of Patent: Oct. 2, 2012

(54) SLOW-WAVE COAXIAL TRANSMISSION LINE HAVING METAL SHIELD STRIPS AND DIELECTRIC STRIPS WITH MINIMUM DIMENSIONS

(75) Inventor: Shu-Ying Cho, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 774 days.

(21) Appl. No.: 12/331,090

(22) Filed: Dec. 9, 2008

(65) Prior Publication Data

US 2010/0141354 A1 Jun. 10, 2010

(51) Int. Cl.
*H01P 3/08* (2006.01)

(52) U.S. Cl. ..... 333/238; 257/664; 257/728; 333/33; 333/243

(58) Field of Classification Search ..... 257/664, 257/728; 333/33–35, 246, 238, 243
See application file for complete search history.

(56) References Cited

U.S. PATENT DOCUMENTS

| | | | |
|---|---|---|---|
| 3,925,740 | A | 12/1975 | Steensma |
| 4,340,873 | A | 7/1982 | Bastida |
| 4,855,537 | A | 8/1989 | Nakai et al. |
| 4,992,851 | A | 2/1991 | Platzoeder et al. |
| 5,313,175 | A | 5/1994 | Bahl et al. |
| 5,753,968 | A | 5/1998 | Bahl et al. |
| 5,841,333 | A | 11/1998 | Fishburn et al. |
| 6,060,383 | A | 5/2000 | Nogami et al. |
| 6,373,740 | B1 | 4/2002 | Forbes et al. |
| 6,465,367 | B1 | 10/2002 | Tsai |
| 6,523,252 | B1 * | 2/2003 | Lipponen ..... 29/828 |
| 6,569,757 | B1 * | 5/2003 | Weling et al. ..... 438/618 |
| 6,624,729 | B2 | 9/2003 | Wright et al. |
| 6,864,757 | B2 | 3/2005 | Du Toit et al. |
| 6,950,590 | B2 | 9/2005 | Cheung et al. |
| 6,985,056 | B2 | 1/2006 | Kanno |
| 7,081,648 | B2 | 7/2006 | Tsai |
| 7,102,456 | B2 | 9/2006 | Berg |
| 7,242,272 | B2 | 7/2007 | Ham et al. |
| 7,305,223 | B2 | 12/2007 | Liu et al. |

(Continued)

FOREIGN PATENT DOCUMENTS

JP 05251914 9/1993

(Continued)

OTHER PUBLICATIONS

Pozar, David M., "Microwave Engineering," 1990, 3 pages, Addison-Wesley, Reading, Massachusetts.

(Continued)

*Primary Examiner* — Benny Lee
(74) *Attorney, Agent, or Firm* — Haynes and Boone, LLP

(57) ABSTRACT

An integrated circuit structure includes an interconnect structure over a semiconductor substrate and a coaxial transmission line. The coaxial transmission line includes a signal line, a top plate over the signal line and electrically insulated from the signal line, and a bottom plate under the signal line and electrically insulated from the signal line. At least one of the top plate and the bottom plate includes metal strip shields and dielectric strips, with each of the dielectric strips being between two of the metal strip shields. The integrated circuit structure further includes a ground conductor electrically connecting the top plate and the bottom plate. The ground conductor is insulated from the signal line by a dielectric material.

17 Claims, 13 Drawing Sheets

U.S. PATENT DOCUMENTS

| | | | | |
|---|---|---|---|---|
| 7,355,554 | B2 * | 4/2008 | Boisbouvier et al. | 343/767 |
| 2001/0040274 | A1 * | 11/2001 | Hidaka | 257/659 |
| 2002/0130739 | A1 * | 9/2002 | Cotton | 333/238 |
| 2004/0017270 | A1 | 1/2004 | Nagra et al. | |
| 2005/0040915 | A1 | 2/2005 | Ryu et al. | |
| 2005/0083152 | A1 | 4/2005 | Hsu et al. | |
| 2009/0195327 | A1 | 8/2009 | Cho et al. | |
| 2009/0302976 | A1 | 12/2009 | Cho | |
| 2010/0141354 | A1 | 6/2010 | Cho | |
| 2010/0214041 | A1 | 8/2010 | Cho | |

FOREIGN PATENT DOCUMENTS

| | | |
|---|---|---|
| KR | 1020080054670 | 6/2008 |

OTHER PUBLICATIONS

Korean Patent Office, Office Action dated May 19, 2011, Application No. 10-2010-0008025; 5 pages and English translation of 5 pages.

* cited by examiner

SLOW-WAVE COAXIAL TRANSMISSION LINE HAVING METAL SHIELD STRIPS AND DIELECTRIC STRIPS WITH MINIMUM DIMENSIONS

CROSS-REFERENCE TO RELATED APPLICATIONS

This application relates to the following commonly-assigned U.S. patent applications: patent application Ser. No. 12/135,659, filed Jun. 9, 2008, and entitled "Microstrip Lines with Tunable Characteristic Impedance and Wavelength;" and patent application Ser. No. 12/023,184, filed Jan. 31, 2008, and entitled "Transmitting Radio Frequency Signal in Semiconductor Structure," now U.S. Pat. No. 8,193,880, issued Jun. 5, 2012, which applications are hereby incorporated herein by reference.

TECHNICAL FIELD

This invention relates generally to the fabrication of integrated circuits, and more particularly to coaxial transmission lines fabricated using complementary metal-oxide-semiconductor (CMOS) compatible processes, and even more particularly to coaxial transmission lines having slow-wave features.

BACKGROUND

Transmission lines are important elements in microwave circuit applications. These devices provide the interconnection between active and passive devices of microwave circuits, and are utilized as impedance matching elements as well. A microstrip line is a type of transmission line widely utilized in monolithic microwave integrated circuit (MMIC) applications.

Microstrip lines have a number of advantages when utilized in MMIC applications. First of all, since microstrip lines are formed of conductive planes disposed on substrates, these devices are readily adaptable to the manufacturing process of the integrated circuits. Accordingly, microstrip lines may be integrated on a same substrate with commonly used integrated circuits such as CMOS circuits.

FIG. 1 illustrates a conventional microstrip line 2 disposed over substrate 4. Microstrip line 2 includes signal line 6, ground plane 8, which is a solid metal plane, and dielectric layer(s) 10 separating signal line 6 from ground plane 8. Ground plane 8 has the advantageous feature of signally isolating signal line 6 from substrate 4, and hence the substrate-induced losses are reduced. However, the formation of ground plane 8 also incurs drawbacks. As the backend processes are scaled down, the vertical distance H between signal line 6 and ground plane 8 becomes significantly smaller, hence requiring signal line 6 to be increasingly narrower in order to achieve the desirable characteristic impedance. Consequently, Ohmic losses in microstrip lines become increasingly more significant, thus demanding better impedance matching between microstrip line 2 and other network devices. Further, limited by the vertical distance H between signal line 6 and ground plane 8, which distance has little room for tuning, ground plane 8 itself becomes a barrier for tuning the characteristic impedance of microstrip line 2.

In addition, microstrip lines typically occupy great chip area. For example, the electro-magnetic wavelength in $SiO_2$ dielectric material is about 3000 μm at 50 GHz. Accordingly, microstrip line 2, with the requirement that its length L1 needs to be at least a quarter of the wavelength, which is about 750 μm, in order to match network impedance, is area-consuming. With the increasing down-scaling of integrated circuits, the chip-area requirement of the microstrip lines becomes a bottleneck preventing the integration of microwave devices and the integrated circuits adopting complementary metal-oxide-semiconductor (CMOS) devices.

Accordingly, what is needed in the art are transmission lines that may take advantage of the benefits associated with the reduced energy losses while at the same time overcoming the deficiencies of the prior art.

SUMMARY OF THE INVENTION

In accordance with one aspect of the present invention, an integrated circuit structure includes an interconnect structure over a semiconductor substrate; and a coaxial transmission line. The coaxial transmission line includes a signal line; a top plate over the signal line and electrically insulated from the signal line; and a bottom plate under the signal line and electrically insulated from the signal line. At least one of the top plate and the bottom plate includes metal strip shields and dielectric strips, with each of the dielectric strips being between two of the metal strip shields. The integrated circuit structure further includes a ground conductor electrically connecting the top plate and the bottom plate. The ground conductor is insulated from the signal line by a dielectric material.

In accordance with another aspect of the present invention, an integrated circuit structure includes a semiconductor substrate; and a plurality of dielectric layers over the semiconductor substrate. The plurality of dielectric layers includes a first dielectric layer; a second dielectric layer over the first dielectric layer; and a third dielectric layer under the first dielectric layer. The integrated circuit structure further includes a coaxial transmission line that includes a signal line in the first dielectric layer, a first ground conductor, a second ground conductor, a top plate, and a bottom plate. The first ground conductor is on a first side of, and is electrically insulated from, the signal line. The first ground conductor extends from inside the second dielectric layer into the third dielectric layer. The second ground conductor is on an opposite side of the signal line than the first ground conductor, and extends from inside the second dielectric layer into the third dielectric layer. The top plate is in the second dielectric layer and includes first metal strip shields and first dielectric strips allocated in an alternating pattern. The bottom plate is in the third dielectric layer and including second metal strip shields and second dielectric strips allocated in an alternating pattern. The first metal strip shields and the second metal strip shields electrically connect the first ground conductor and the second ground conductor.

In accordance with yet another aspect of the present invention, an integrated circuit structure includes a coaxial transmission line, which further includes a signal line extending in a first direction; and a ground line encircling the signal line. The ground line includes a top plate including a first plurality of metal strip shields spaced apart from each other; a bottom plate including a second plurality of metal strip shields spaced apart from each other, wherein a lengthwise direction of the first and the second pluralities of metal strip shields is in a second direction substantially perpendicular to the first direction; and a first ground conductor and a second ground conductor on opposite sides of the signal line. Each of the first ground conductor and the second ground conductor interconnects the first plurality of metal strip shields to the second plurality of metal strip shields.

The advantageous features of the present invention include reduced energy loss in coaxial transmission lines, and tunable characteristic impedances. In addition, the formation of the coaxial transmission lines is highly compatible with existing CMOS manufacturing processes.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
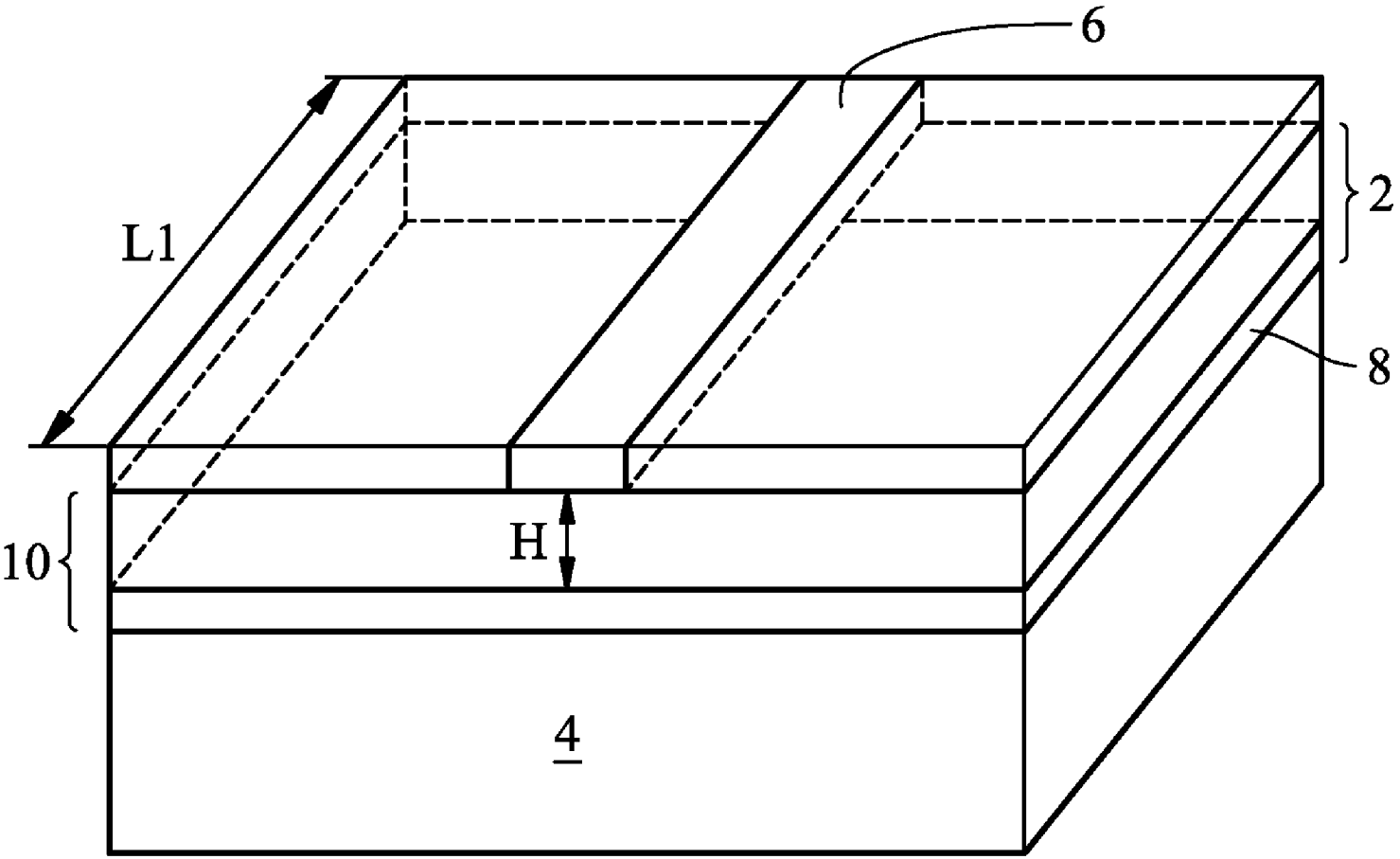
FIG. 1 (PRIOR ART)
FIG. 1 illustrates a conventional microstrip line including a signal line and a solid ground plane, wherein the solid ground plane is between the signal line and an underlying substrate.
Figure 2A:
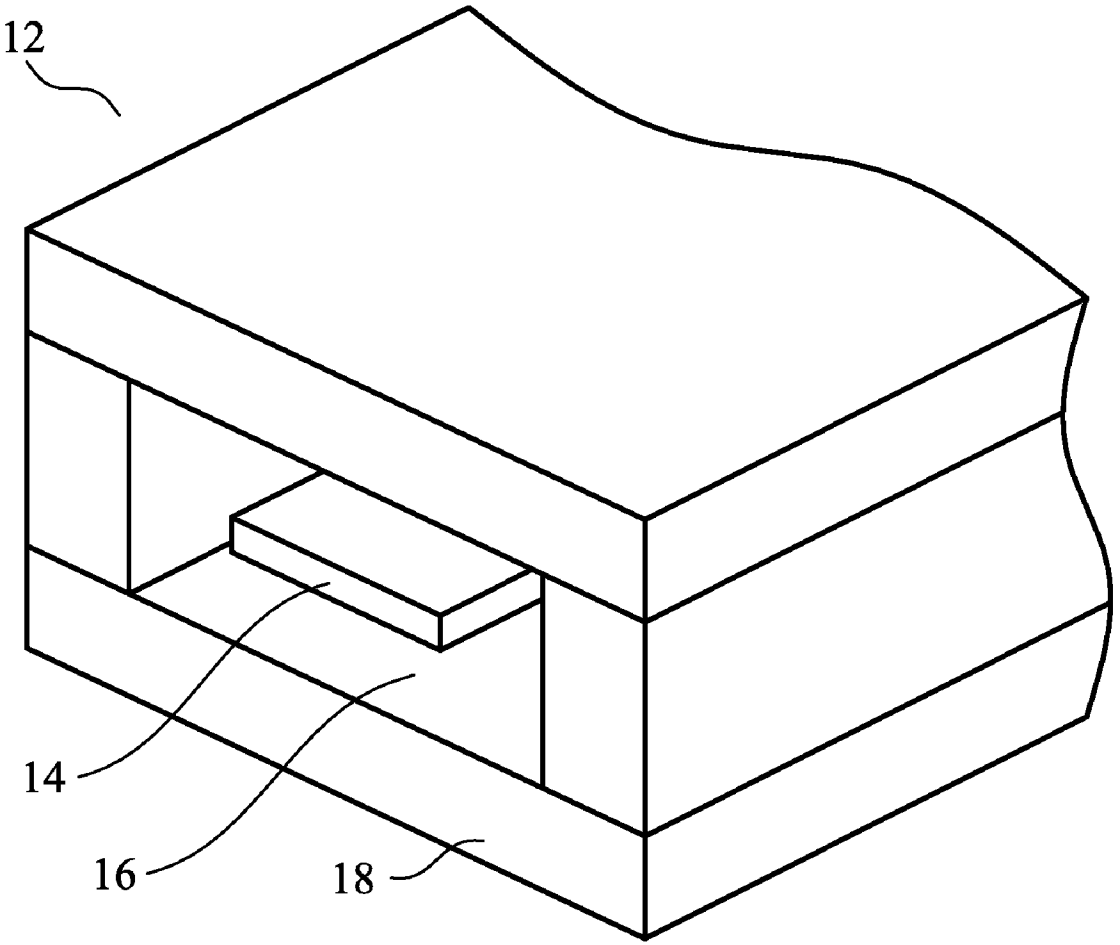
FIGS. 2A and 2B illustrate a cross-sectional view and a perspective view of a coaxial transmission line with a signal line encircled by a solid ground line.
Figure 2B:
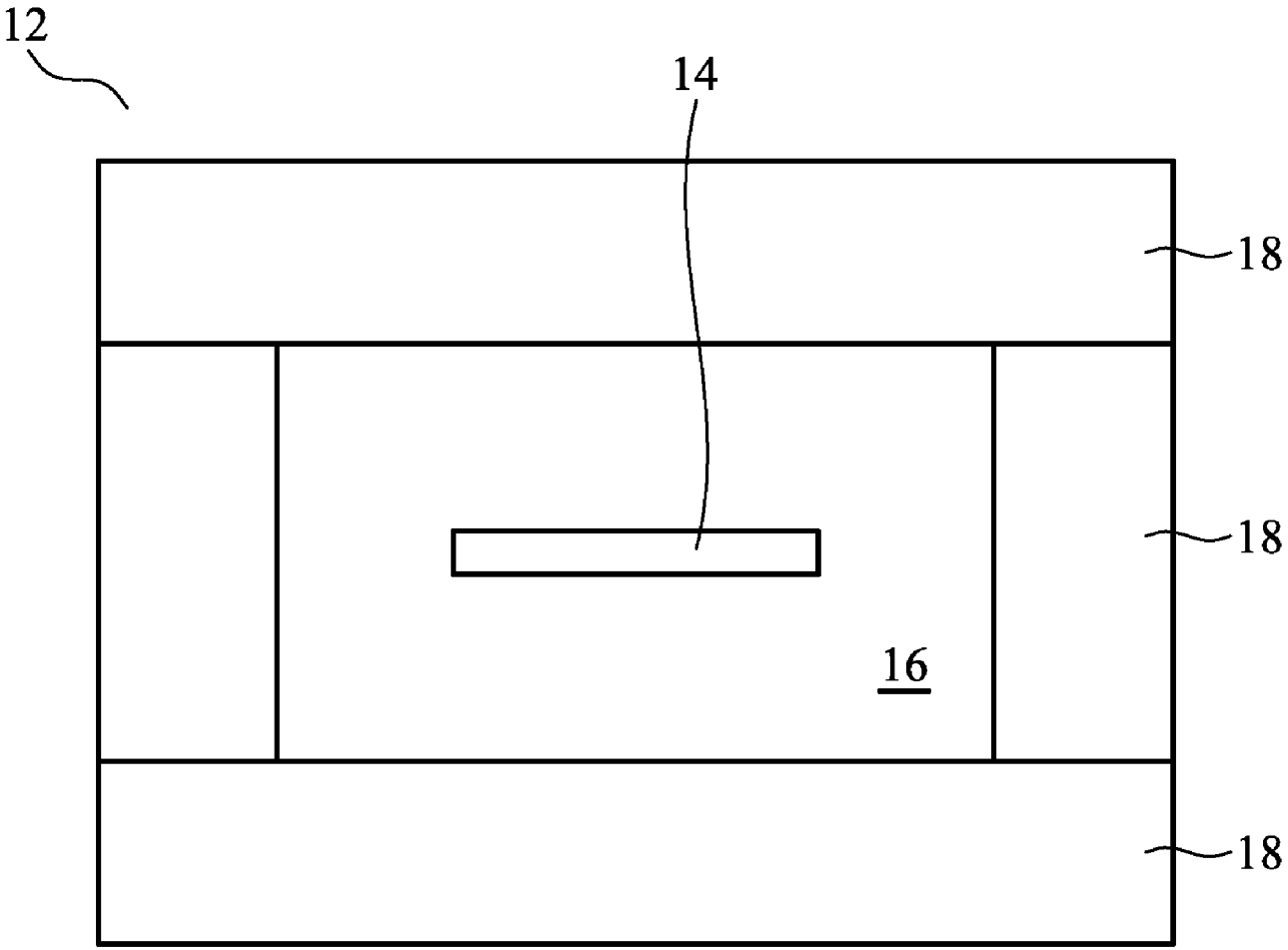

Since conventional unshielded transmission lines suffer from high-energy loss, coaxial transmission lines were developed for more efficient signal transmission. U.S. patent application Ser. No. 12/023,184, which is incorporated herein by reference, discloses coaxial transmission line 12, as shown in FIGS. 2A and 2B. FIG. 2A is a perspective view, while FIG. 2B is a cross-sectional view, of coaxial transmission line 12. Signal line 14 is surrounded by dielectric material(s) 16. Encircling dielectric material(s) 16 is ground line 18, which forms a solid metal shield for signal line 14. Since signal line 14 is surrounded by ground line 18, the leakage of electromagnetic fields, if any, is minimal, and hence the energy loss is minimized.

The manufacturing of coaxial transmission line 12, however, faces process difficulties. Since the length and the width of coaxial transmission line 12 typically have large values, the manufacturing process violates the CMOS design rules. Particularly, the manufacturing of coaxial transmission line 12 involves chemical mechanical polishes (CMPs). However, the large size of the top plate and the bottom plate of ground line 18 causes the well-known micro-loading effect and dishing effect. In addition, the propagation speed of coaxial transmission line 12 is controlled only by the properties of dielectric material 16, and thus it is difficult to tune the characteristic wavelength of coaxial transmission line 12.

To improve the process compatibility of coaxial transmission lines with the CMOS manufacturing processes and to make the characteristic wavelengths adjustable, novel coaxial transmission lines having tunable characteristic impedances and tunable characteristic wavelengths are provided. The variations of the preferred embodiments are then discussed. Throughout the various views and illustrative embodiments of the present invention, like reference numbers are used to designate like elements.

Embodiments of the invention relate to integrated circuits having a coaxial transmission line including at least one ground conductor coupled with a top plate and a bottom plate, at least one of which having metal strip shields and dielectric strips, each dielectric strip between two of the metal strip shields. The coaxial transmission line can provide tunable characteristic impedances and/or slow-wave features by adjusting widths and spacings of the metal strip shields.

Figure 3A:
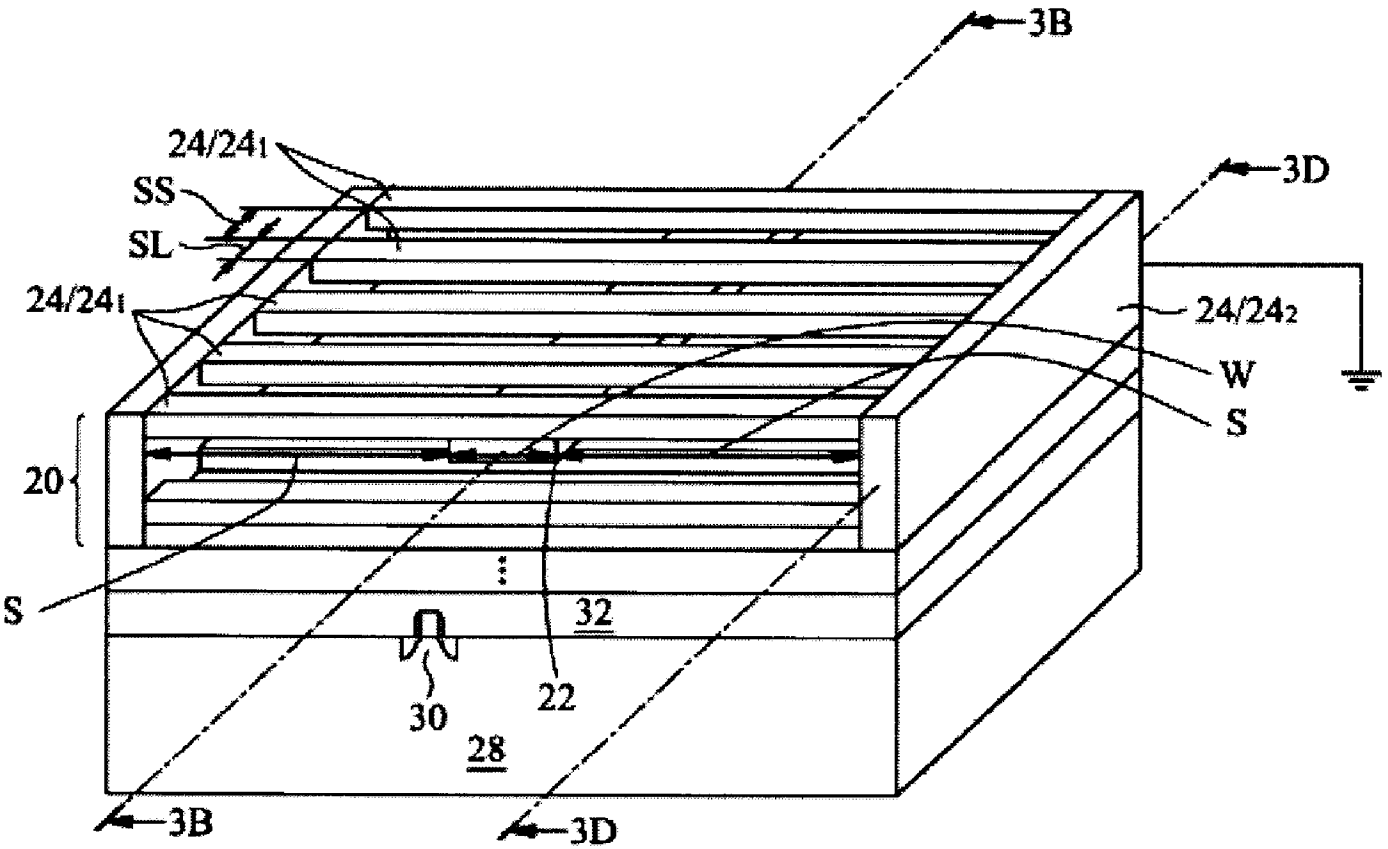
FIG. 3A illustrates a perspective view of an embodiment of the present invention, wherein a ground line of a coaxial transmission line includes metal strip shields separated by dielectric strips.

FIG. 3A illustrates a perspective view of an exemplary embodiment. Coaxial transmission line 20, which includes signal line 22, patterned ground line 24, and dielectric layer(s) 26 (refer to FIG. 3B), is formed over substrate 28. In an embodiment, substrate 28 is a semiconductor substrate, and may include commonly used semiconductor materials such as silicon, germanium, and the like. The structure shown in FIG. 3A is a portion of a semiconductor chip, which may further include other regions having no microwave transmission line(s) formed thereon. Integrated circuits 30, such as complementary metal-oxide-semiconductor (CMOS) devices, may be formed at the surface of substrate 28. Integrated circuits 30 are symbolized by a MOS device.

Figure 3B:
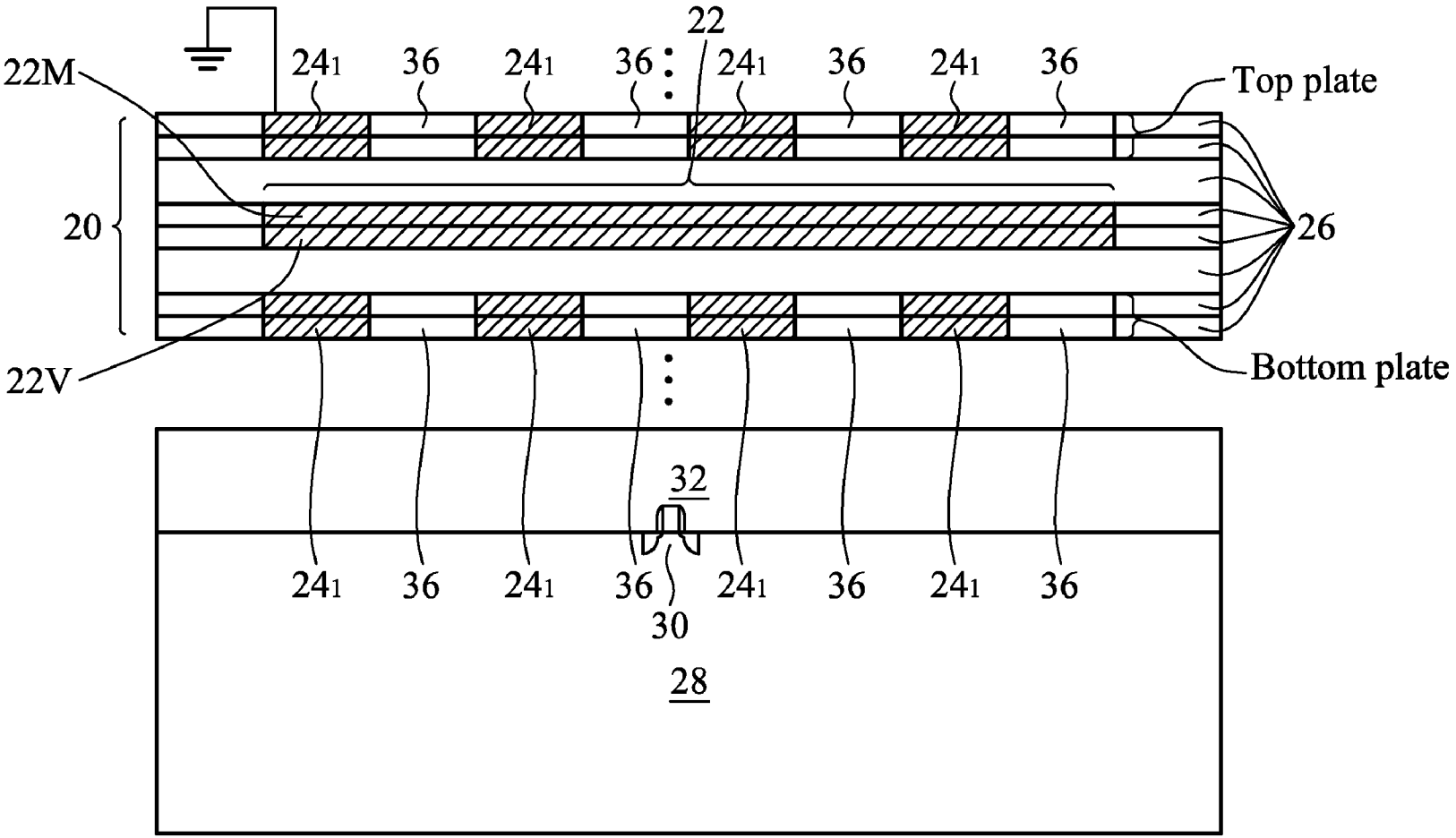
FIGS. 3B through 3E are cross-sectional views and a top view of the embodiment shown in FIG. 3A.

FIG. 3B illustrates a cross-sectional view of the structure shown in FIG. 3A, wherein the cross-sectional view is taken along a vertical plane crossing line 3B-3B in FIG. 3A. Ground line 24 (FIG. 3A), as the name suggests, is preferably grounded. Ground line 24 may be formed over inter-layer dielectric (ILD) 32, in which contact plugs (not shown) connected to the integrated circuits 30 are formed. In an embodiment, ground line 24 extends through a plurality metallization layers, which may include one or more metallization layers (including any of the layers ranging from a bottom metallization layer to top metallization layer). Dielectric layers 26 may thus include low-k dielectric materials, for example, with dielectric constants lower than about 3.0, or even about 2.5 or lower. Ground line 24 may also extend into upper dielectric layers including an un-doped silicate glass (USG) layer and even the overlying passivation layers that are commonly formed using non-dual damascene processes.

Figure 3C:
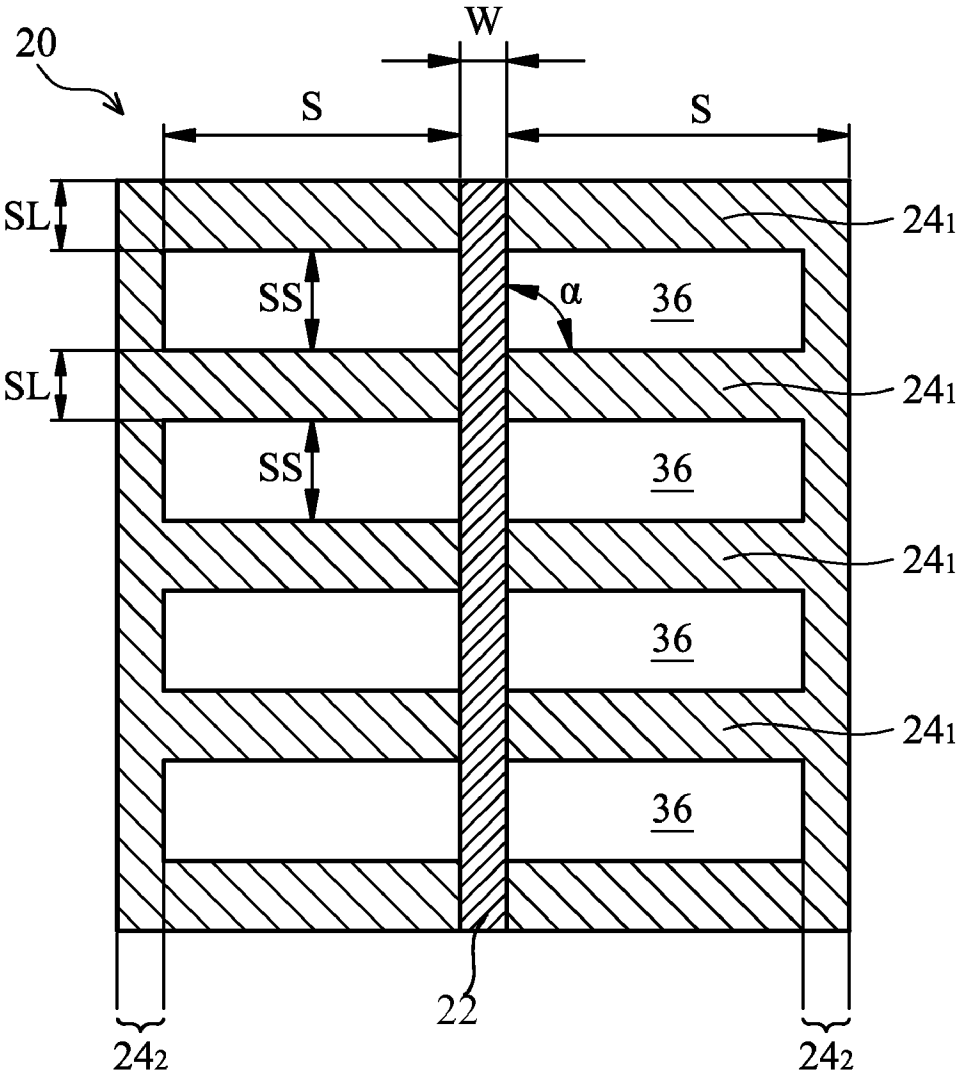

Referring to FIGS. 3A and 3B, ground line 24, which is formed of metals, for example, copper, includes a top plate overlying signal line 22, and a bottom plate underlying signal line 22. In the preferred embodiment, both the top plate and the bottom plate include a plurality of metal strip shields $\mathbf{24}_1$ separated from each other and having lengthwise directions perpendicular to the lengthwise direction of signal line 22. Preferably, the angle a as shown in FIG. 3C is 90 degrees, although angle a may be smaller or greater than 90 degrees. In alternative embodiments, only one of the top plate and the bottom plate includes metal strip shields $\mathbf{24}_1$ separated by dielectric materials, while the other one form a solid plate. Ground conductors $\mathbf{24}_2$, which are the sidewall portions of ground line 24 (FIG. 3A), interconnect metal strip shields $\mathbf{24}_1$. In the preferred embodiment, ground conductors $\mathbf{24}_2$ are parallel to, or are at least substantially parallel to, signal line 22. Each of the metal strip shields $\mathbf{24}_1$ in the top plate preferably vertically overlaps one of the metal strip shields $\mathbf{24}_1$ in the bottom plate, although they may also be vertically misaligned.

Referring to FIG. 3C, which is a top view of the structure shown in FIG. 3A (the top plate is not shown), metal strip shields $\mathbf{24}_1$ have lengths SL, and are spaced from each other by dielectric regions 36 (alternatively referred to as dielectric strips hereinafter), whose widths are also the spacings SS between metal strip shields $\mathbf{24}_1$. To effectively shield substrate 28 from the signal carried in signal line 22 and considering the transmission line performance, such as attenuation loss, quality factor, and wavelength, lengths SL can be as small as possible. In embodiments, lengths SL can be less than about twice the minimum lengths allowed by the forming technology. In other embodiments, lengths SL can be equal to the minimum length. In an exemplary embodiment in which the integrated circuits are formed using 45 nm technology, lengths SL and strip spacings SS can be between about 70 nm and about 4 μm. The design for various combinations of different strip lengths SL and strip spacings SS is considered based on the specification requirement for different applications. The values of spacing SS and lengths SL of strip shields $\mathbf{24}_1$ may affect the performance of the characteristic impedance and the characteristic wavelength of the resulting coaxial transmission line 20, and the optimum values can be found through experiments. In the preferred embodiment, signal line 22 is located horizontally in the middle of the opposing ground conductors $\mathbf{24}_2$, and is spaced apart from ground conductors $\mathbf{24}_2$ by spacing S.

Strip lengths SL of different strip shields $\mathbf{24}_1$ preferably have a periodic pattern, that is, neighboring strip shields $\mathbf{24}_1$ may be grouped, with strip lengths SL of strip shields $\mathbf{24}_1$ in one group repeating the width pattern in other groups. In each of the groups, the strip lengths SL may be arranged in an order from smaller to greater (for example, forming an arithmetic sequence or a geometric sequence), with each of strip lengths SL being greater than a previous one. More preferably, in each of the top plate and the bottom plate of ground line 24, all of strip shields $\mathbf{24}_1$ preferably have a same strip length SL, although strip lengths SL may also be different from each other. Similarly, all spacings SS between neighboring strip shields $\mathbf{24}_1$ are preferably equal to each other. Alternatively, spacings SS may have other periodic patterns similar to that of strip lengths SL.

The formation methods of signal line 22 and ground line 24 (FIG. 3A) may include commonly known single and dual damascene processes, wherein signal line 22 and ground line 24 are formed of copper or copper alloys. Accordingly, signal line 22 may include only a metal line portion, but not a via portion. Alternatively, as shown in FIG. 3B, signal line 22 may include a metal line portion 22M and an underlying via portion 22V. Further, signal line 22 may span into more than one dielectric layer, with one metal line portion and one via portion of signal line 22 in each of the dielectric layers. In the case signal line 22 and/or ground line 24 extend into the passivation layers, the formation methods may include depositing a metal layer, patterning the metal layer by etching, and filling the spacing between the remaining portions of the metal layer with dielectric materials.

Figure 3D:
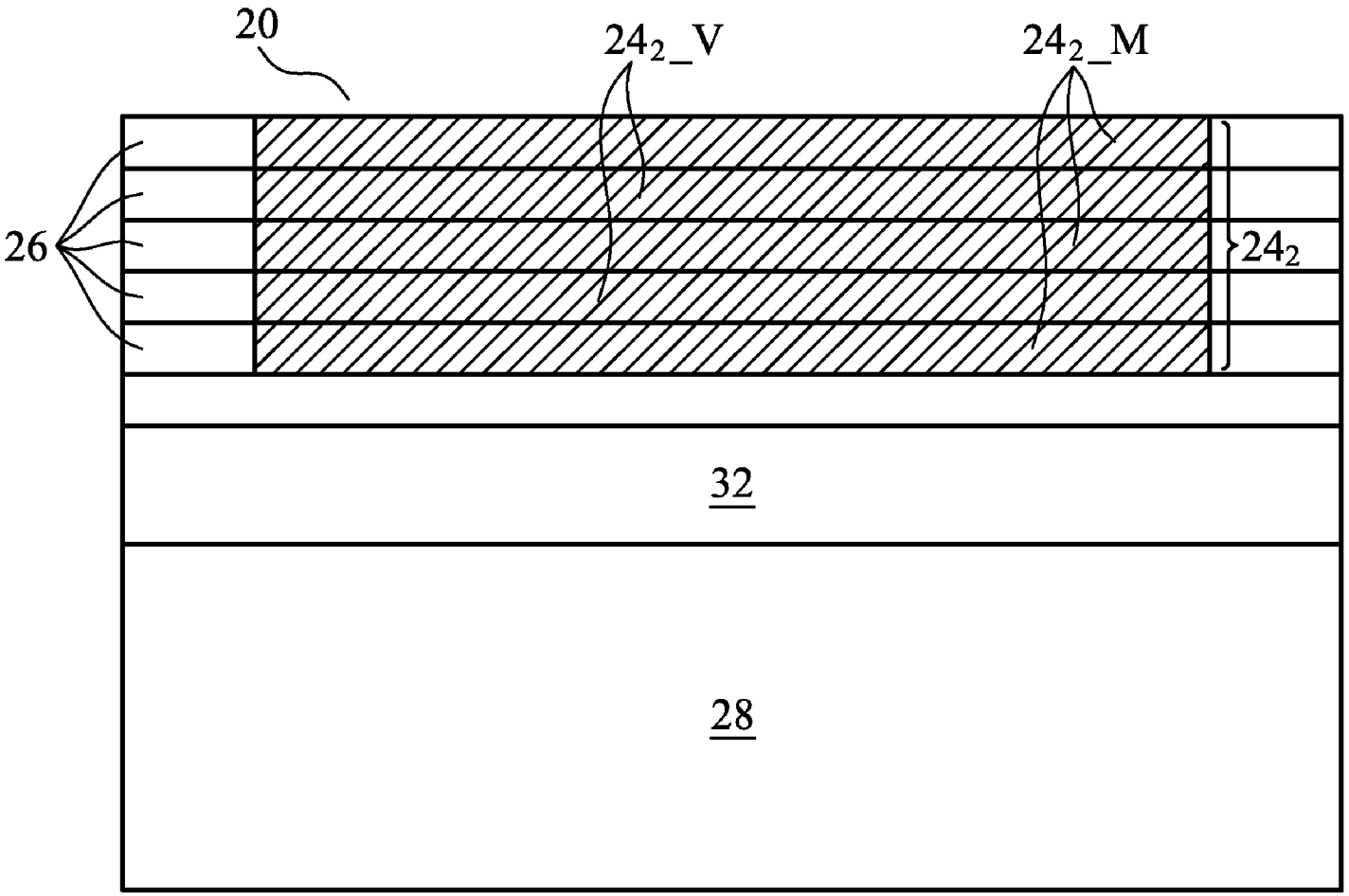
Figure 3E:
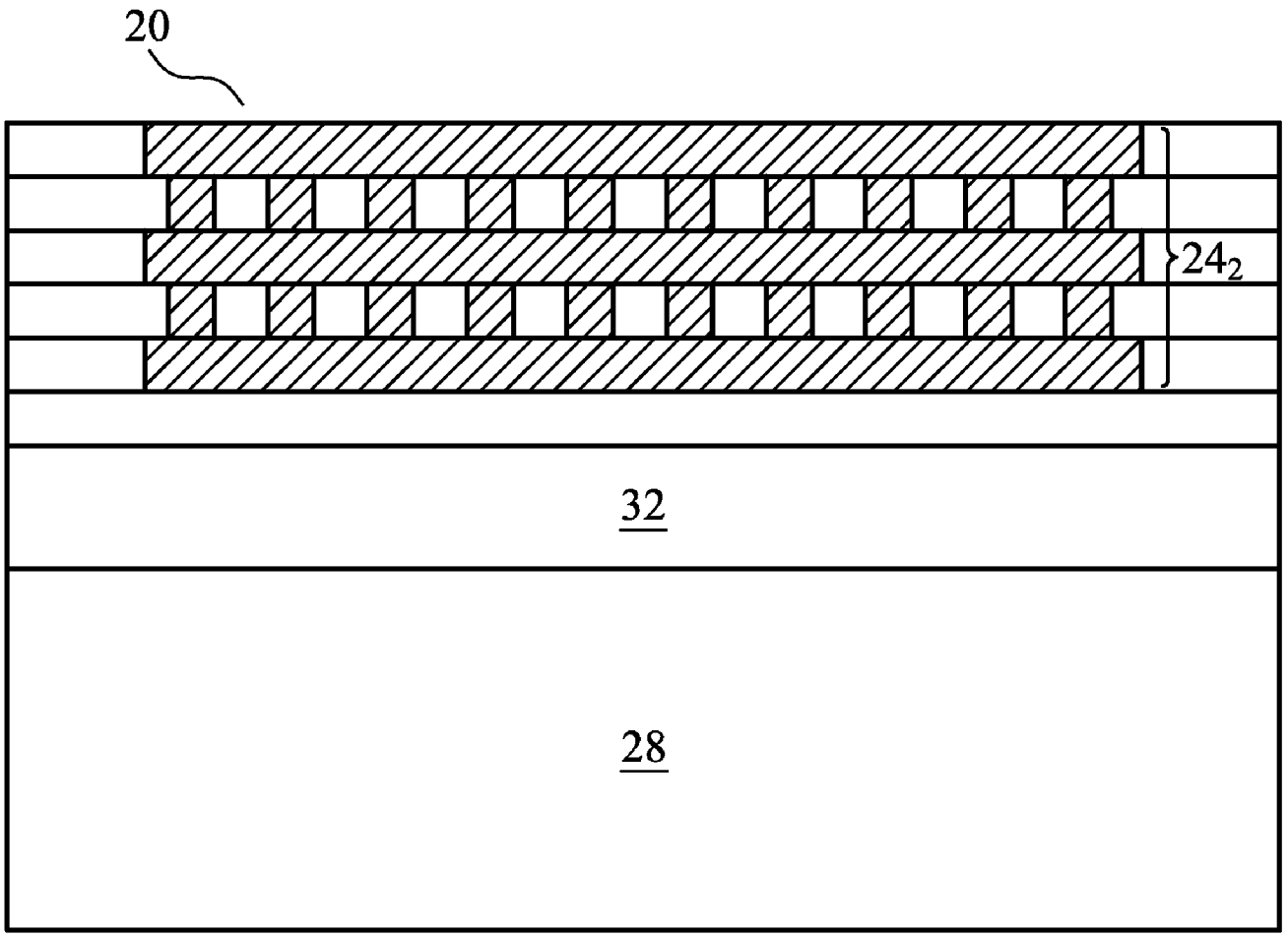

Referring to FIGS. 3A, 3D, and 3E, ground line 24 (FIG. 3A) includes a plurality of portions, each located in one of dielectric layers 26 (FIG. 3D). In an embodiment of the present invention, the portions of ground line 24 in different dielectric layers 26 are interconnected by via bars $\mathbf{24}_2$_V (as shown in FIG. 3D) that are co-terminus with the overlying metal line portion $\mathbf{24}_2$_M. Accordingly, as shown in FIG. 3D (a cross-sectional view taken along a vertical plane crossing line 3D-3D in FIG. 3A), ground conductors $\mathbf{24}_2$ are solid sidewalls. Alternatively, in FIG. 3E, which is an alternative cross-sectional view taken along the vertical plane crossing line 3E-3E in FIG. 4 (an alternative embodiment of the present invention), the via portions of ground conductors $\mathbf{24}_2$ include periodically located via columns underlying metal lines portions, wherein the metal line portions are continuous. The via portions of ground conductors $\mathbf{24}_2$ are separated from each other by dielectric regions. Similarly, signal line 22 (FIG. 3A) may also include more than one layer, each located in a metallization layer, with via columns or solid via bars connecting the layers of signal line 22.

In coaxial transmission lines that have solid ground planes, the signal return path is mostly in the top plate and the bottom plate, and at positions directly overlying and underlying the respective signal line. Advantageously, in the embodiments of the present invention, dielectric strips 36 (refer to FIG. 3C) traverse the signal return path directly overlying and underlying signal line 22. The signal return paths are thus forced to ground conductors $\mathbf{24}_2$, which are spaced far from signal line 22. Accordingly, the characteristic impedance and characteristic wavelength may be tuned by adjusting the distance between the opposing ground conductors $\mathbf{24}_2$, which adjustment may be achieved by adjusting strip spacings SS of metal strip shields $\mathbf{24}_1$ (refer to FIG. 3C). Advantageously, the periodic pattern of metal strip shields $\mathbf{24}_1$ and dielectric strips 36 results in a slow-wave feature. This is partially caused by the difference in characteristic capacitances between portions of coaxial transmission line 20 comprising dielectric strips 36, and portions of coaxial transmission line 20 comprising metal strip shields $\mathbf{24}_1$.

Figure 4:
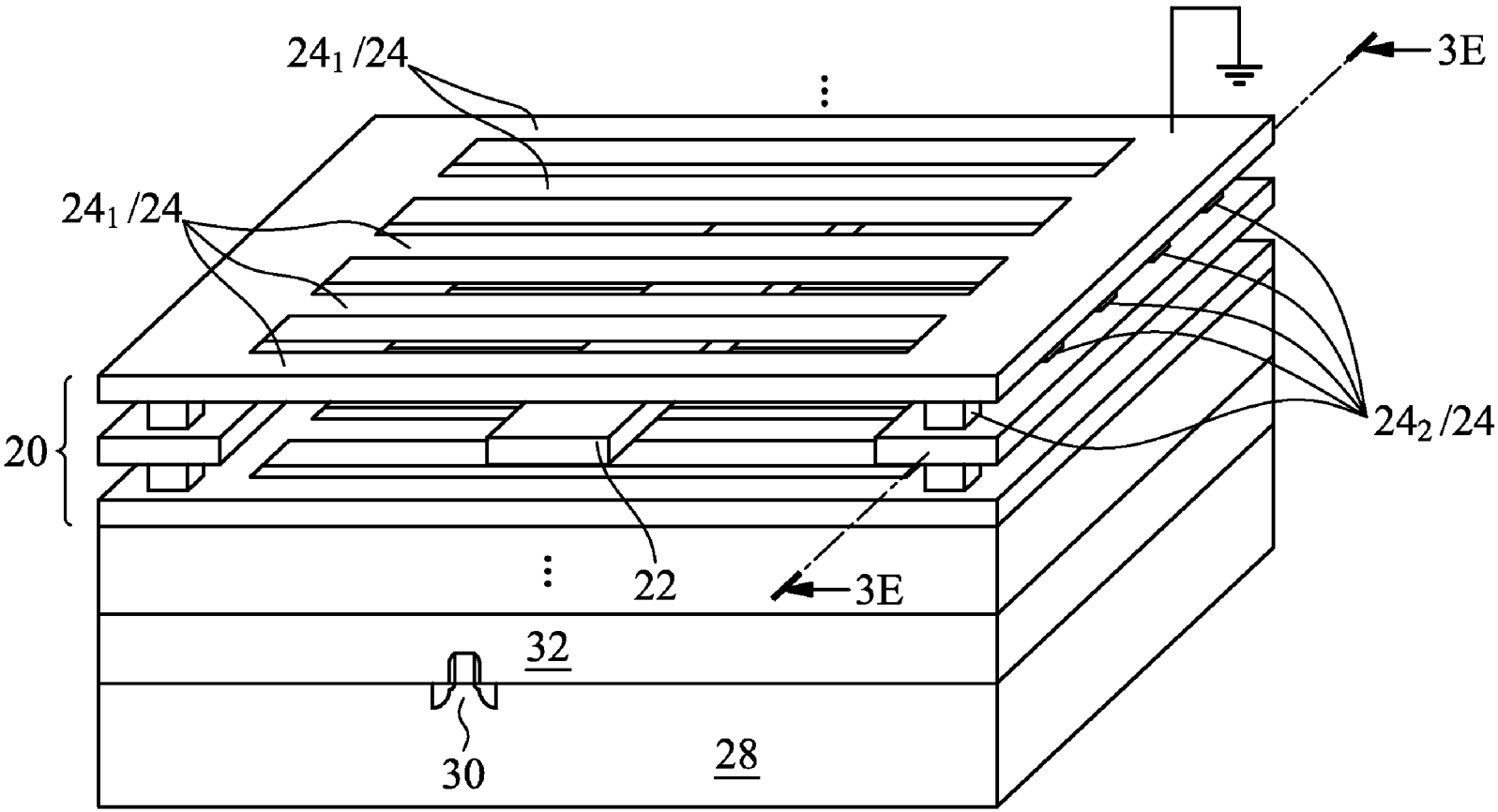
FIG. 4 illustrates a perspective view of the embodiment shown in FIG. 3E.

FIGS. 5 through 8 are simulation results. It is found through these results that the characteristics of the coaxial transmission line embodiments of the present invention may be adjusted by tuning the width W of signal line 22 (refer to FIG. 3C), and by tuning the spacing S between signal line 22 and ground conductors $\mathbf{24}_2$. Table 1 lists the widths W (FIG. 3C) and spacings S of sample coaxial transmission lines having the structure as shown in FIG. 4, on which the simulations are performed.

TABLE 1

| Sample Name | Width (W, μm) | Spacing (S, μm) |
|---|---|---|
| SMS1 | 10 | 3 |
| SMS2 | 10 | 8 |
| SMS3 | 10 | 20 |
| SMS4 | 10 | 100 |
| SMS5 | 2 | 20 |
| SMS6 | 2 | 100 |

Figure 5:
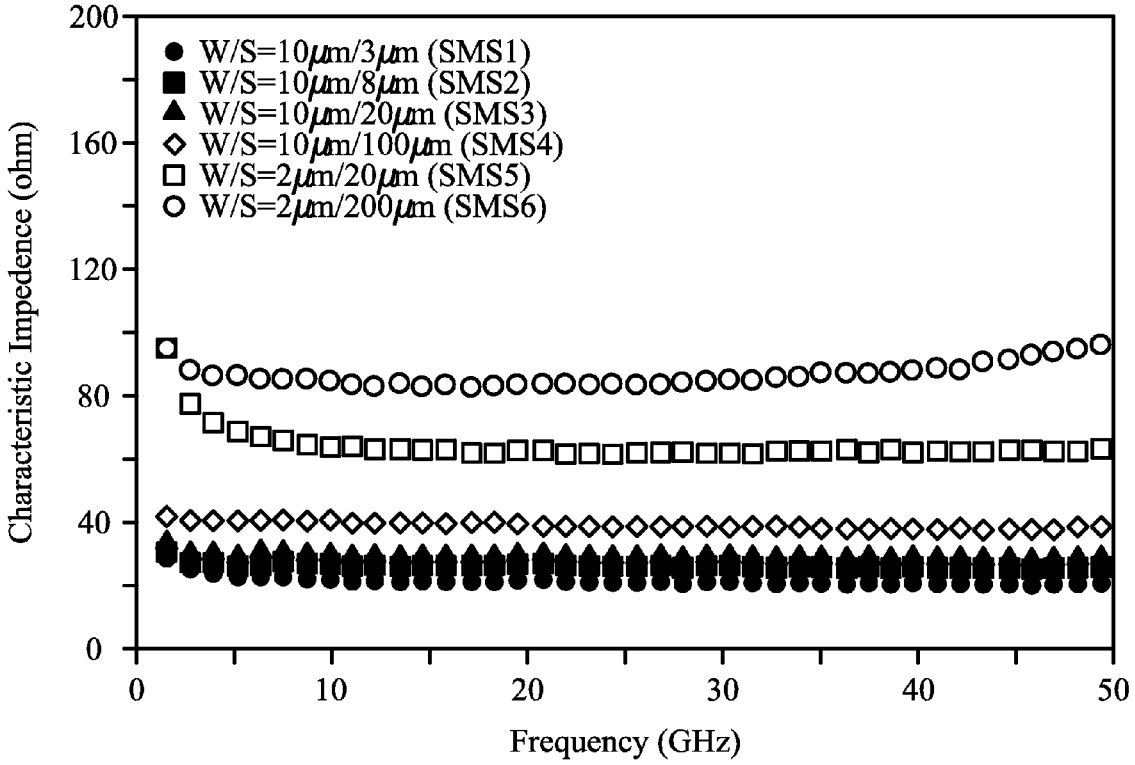
FIG. 5 shows simulation results, wherein the characteristic impedances of sample coaxial transmission lines are illustrated as a function of frequencies.

FIG. 5 illustrates the characteristic impedances of the sample coaxial transmission lines as a function of frequencies. The results obtained from samples SMS1, SMS2, SMS3, and SMS4 reveal that at any microwave frequency, the characteristic impedances of the embodiments of the present invention increase with the increase in width W of signal line 22. Accordingly, the characteristic impedances of the embodiments may be tuned by adjusting width W of signal line 22. Further, it is noted that the characteristic impedance of samples SMS5 and SMS6 are significantly greater than the characteristic impedances of samples SMS3 and SMS4, respectively. This indicates that reducing width W of signal line 22 also has the effect of increasing the characteristic impedance. Therefore, the characteristic impedances of the embodiments of the present invention may be adjusted in a significant range.

Figure 6:
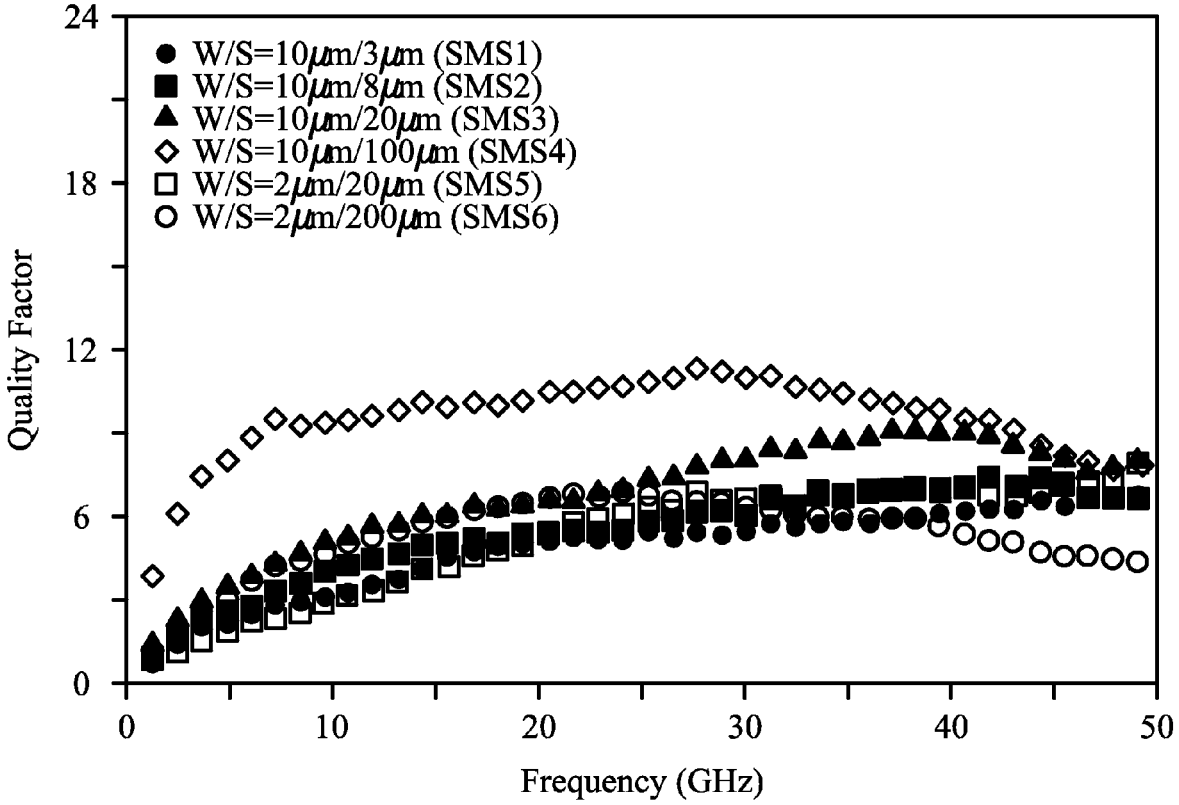
FIG. 6 shows simulation results, wherein the quality factors of the sample coaxial transmission lines are illustrated as a function of the frequencies.

FIG. 6 illustrates the quality factors of the sample coaxial transmission lines as a function of the frequencies. The quality factors shown in FIG. 6 are higher than that of the conventional coaxial transmission lines, and are comparable to the quality factors of those coaxial transmission lines fabricated on insulating or semi-insulating substrates.

Figure 7:
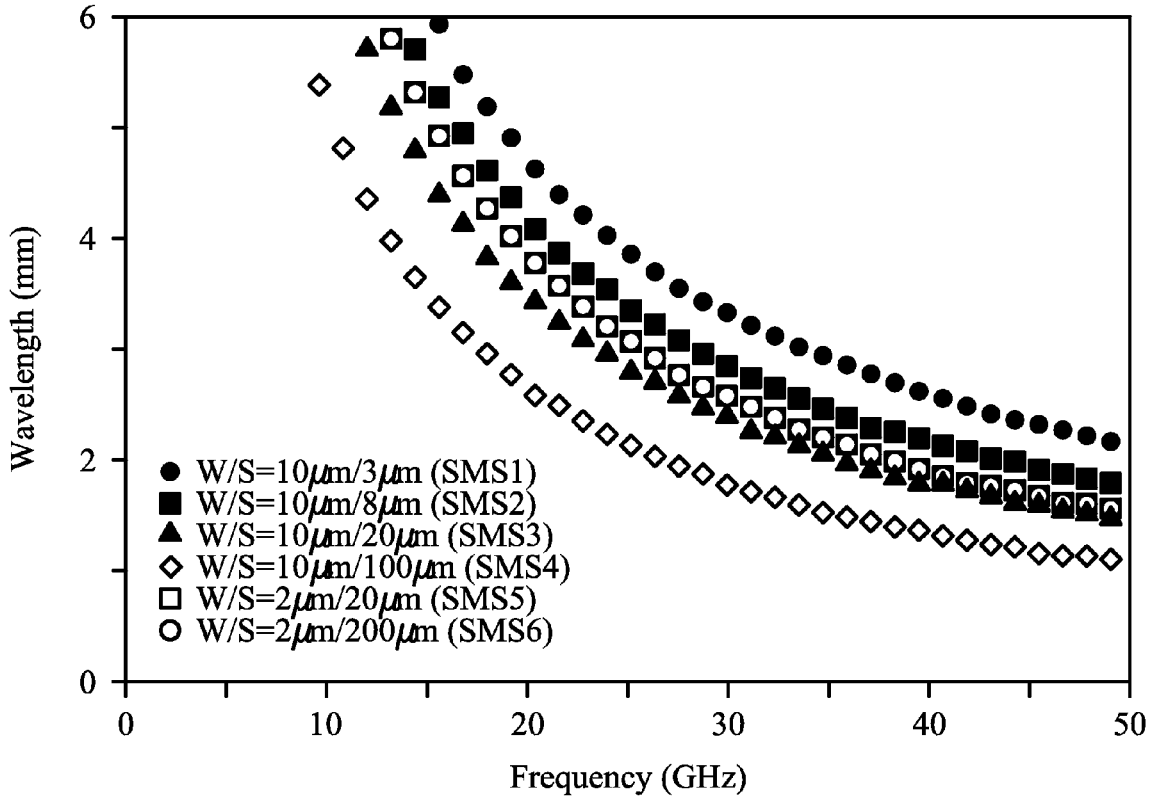
FIG. 7 shows simulation results, wherein the characteristic wavelengths of the sample coaxial transmission lines are illustrated as a function of the frequencies.

FIG. 7 illustrates the characteristic wavelengths of the sample coaxial transmission lines as a function of the frequencies. The results obtained from samples SMS1, SMS2, SMS3, and SMS4 reveal that at any microwave frequency, the characteristic wavelengths of the embodiments of the present invention decrease with the increase in width W of signal line 22. Accordingly, the characteristic wavelengths of the embodiments of the present invention may be tuned by adjusting width W of signal line 22.

Figure 8:
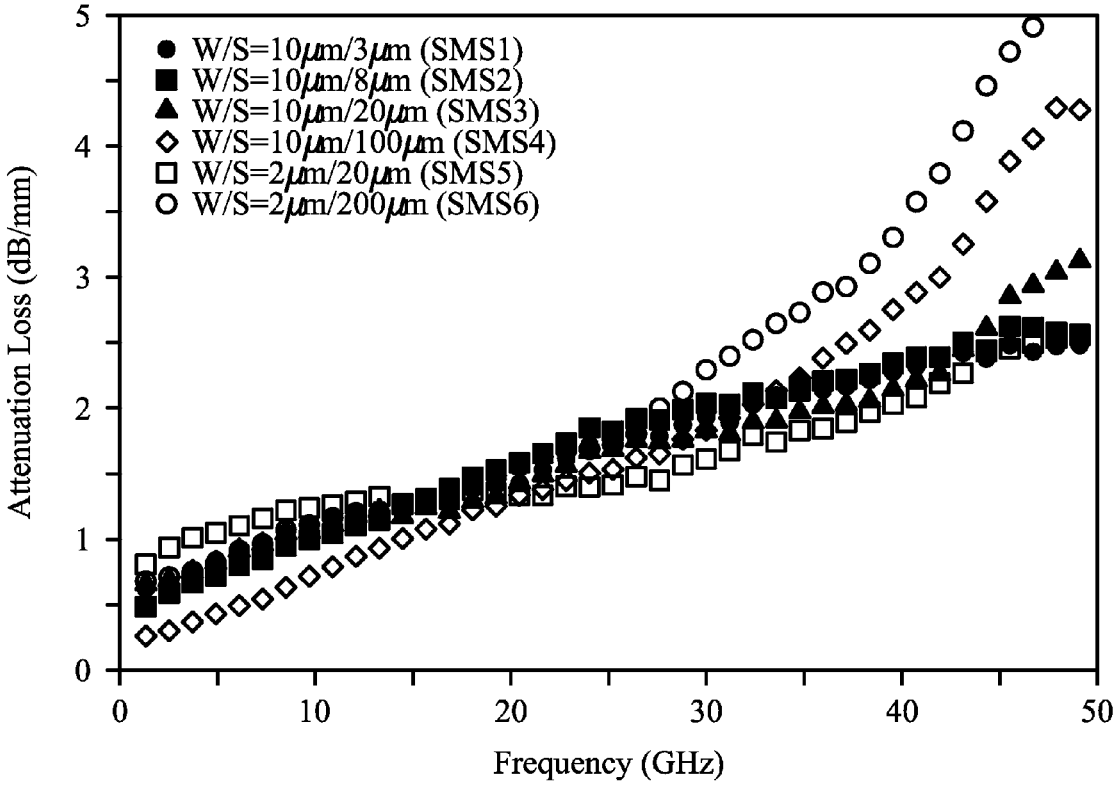
FIG. 8 shows simulation results, wherein attenuation losses of the sample coaxial transmission lines are illustrated as a function of the frequencies.

FIG. 8 illustrates the attenuation loss of the sample coaxial transmission lines as a function of frequencies. The results appear to demonstrate that a higher attenuation loss may be induced by the eddy-current on the longer strip shields (samples SMS4 and SMS6, which have spacings S equal to 100 μm and 200 μm, respectively). The undesirable eddy-current power loss may be reduced by minimizing strip lengths SL (FIGS. 3A and 4), which can be readily achieved as the scaling down of backend processes continues.

The embodiments of the present invention have several advantageous features. First, the characteristic impedances and characteristic wavelengths may be tuned by adjusting the distances between ground conductors. Second, by forming periodical, instead of solid, top plate and bottom plate, the formation of the coaxial transmission lines is now fully compatible with the formation processes of CMOS circuits. The formation of the embodiments of the present invention do not need additional masks, and hence the manufacturing cost is not increased.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An integrated circuit structure comprising:
- a semiconductor substrate;
- an interconnect structure over the semiconductor substrate; and
- a coaxial transmission line comprising:
  - a signal line;
  - a top plate over the signal line and electrically insulated from the signal line;
  - a bottom plate under the signal line and electrically insulated from the signal line,
- wherein at least one of the top plate and the bottom plate comprises:
  - metal strip shields; and
  - dielectric strips, each between two of the metal strip shields; and
  - a first ground conductor electrically connecting the top plate and the bottom plate,
- wherein the first ground conductor is insulated from the signal line by a dielectric material,
- wherein the metal strip shields and the dielectric strips have widths substantially equal to a minimum dimension of the integrated circuit structure.

2. The integrated circuit structure of claim 1 further comprising a second ground conductor electrically connecting the top plate and the bottom plate, wherein the second ground conductor is on an opposite side of the signal line than the first ground conductor.

3. The integrated circuit structure of claim 1, wherein both the top plate and the bottom plate comprise the metal strip shields and the dielectric strips.

4. The integrated circuit structure of claim 1, wherein the metal strip shields have lengthwise directions substantially perpendicular to a lengthwise direction of the signal line.

5. The integrated circuit structure of claim 1, wherein the first ground conductor extends into a plurality of dielectric layers, and wherein in each of the plurality of dielectric layers, the first ground conductor comprises a metal line portion and a via portion forming a solid vertical metal wall.

6. The integrated circuit structure of claim 1, wherein the first ground conductor extends into a plurality of dielectric layers, wherein in each of the plurality of dielectric layers, the first ground conductor comprises a metal line portion and a plurality of vias underlying and contacting the metal line portion, and wherein the plurality of vias is separated from each other by dielectric regions.

7. An integrated circuit structure comprising:
- a coaxial transmission line comprising:
  - a signal line extending in a first direction; and
  - a ground line encircling the signal line, wherein the ground line comprises:
    - a top plate comprising a first plurality of metal strip shields spaced apart from each other;
    - a bottom plate comprising a second plurality of metal strip shields spaced apart from each other, wherein a lengthwise direction of the first and the second pluralities of metal strip shields is in a second direction substantially perpendicular to the first direction; and
    - a first ground conductor and a second ground conductor on opposite sides of the signal line, wherein each of the first ground conductor and the second ground conductor interconnects the first plurality of metal strip shields to the second plurality of metal strip shields,
- wherein each of the first plurality of metal strip shields and the second plurality of metal strip shields has a width substantially equal to a minimum dimension of the integrated circuit.

8. The integrated circuit structure of claim 7, wherein the first plurality of metal strip shields and the second plurality of metal strip shields have a same width.

9. The integrated circuit structure of claim 7 further comprising dielectric materials filling first spacings between the first plurality of metal strip shields and second spacings between the second plurality of metal strip shields.

10. An integrated circuit structure comprising:

a coaxial transmission line comprising:

a signal line;

a top plate over the signal line and electrically insulated from the signal line;

a bottom plate under the signal line and electrically insulated from the signal line, wherein at least one of the top plate and the bottom plate comprises:

metal strip shields; and dielectric strips, each between two of the metal strip shields; and a first ground conductor electrically connecting the top plate and the bottom plate, wherein the first ground conductor comprises a first metal line and a second metal line that are spaced apart from each other and a plurality of vias extending from the first metal line to the second metal line to connect the first metal line and the second metal line, the plurality of vias separated from each other by a dielectric material, wherein the metal strip shields and the dielectric strips have widths substantially equal to a minimum dimension of the integrated circuit structure.

11. The integrated circuit structure of claim 10, wherein each via of the plurality of vias has a top surface in physical contact with the first metal line, a bottom surface in physical contact with the second metal line, and opposing side wall surfaces extending from the top surface to the bottom surface that are in physical contact with the dielectric material.

12. The integrated circuit structure of claim 10, further comprising a semiconductor substrate, wherein the coaxial transmission line is formed over the semiconductor substrate.

13. The integrated circuit structure of claim 10, further comprising a second ground conductor on an opposite side of the signal line with respect to the first ground connector and electrically connecting the top plate and the bottom plate, the second ground conductor having a third metal line and a fourth metal line that are spaced apart from each other and a plurality of vias extending from the third metal line to the fourth metal line to connect the first metal line and the second metal line, the plurality of vias separated from each other by the dielectric material.

14. The integrated circuit structure of claim 10, wherein the plurality of vias are spaced apart from one another a substantially equal distance.

15. The integrated circuit structure of claim 10, wherein the dielectric material is a low k dielectric.

16. The integrated circuit structure of claim 10, wherein both the top plate and the bottom plate comprise the metal strip shields and the dielectric strips.

17. The integrated circuit structure of claim 16, wherein the metal strip shields have lengthwise directions substantially perpendicular to a lengthwise direction of the signal line.

* * * * *